US006422165B1

(12) United States Patent
Tanaka et al.

(10) Patent No.: US 6,422,165 B1
(45) Date of Patent: Jul. 23, 2002

(54) APPARATUS FOR PREVENTING RAVELING OF SEAM

(75) Inventors: Yoshiyuki Tanaka; Takayuki Hayashida, both of Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/694,162

(22) Filed: Oct. 23, 2000

(30) Foreign Application Priority Data

Nov. 9, 1999 (JP) ..... 11-318904

(51) Int. Cl.[7] ..... D05B 1/10; D05B 19/12

(52) U.S. Cl. ..... 112/470.01; 112/165; 112/199; 112/300

(58) Field of Search ..... 112/470.01, 197, 112/199, 200, 163, 165, 187, 475.17, 300

(56) References Cited

U.S. PATENT DOCUMENTS 6,109,195 A * 8/2000 Inagaki et al. ..... 112/470.01

6,119,613 A * 9/2000 Douyasu ..... 112/199 X

FOREIGN PATENT DOCUMENTS

| | | |
|---|---|---|
| JP | 9-225163 | 9/1997 |
| JP | 2879399 | 1/1999 |
| JP | 11-57253 | 3/1999 |
| JP | 11-57268 | 3/1999 |
| JP | 11-70281 | 3/1999 |
| TW | 363621 | 7/1999 |
| TW | 365264 | 7/1999 |
| TW | 366011 | 8/1999 |

* cited by examiner

*Primary Examiner*—Peter Nerbun
(74) *Attorney, Agent, or Firm*—Darby & Darby

(57) ABSTRACT

An apparatus for preventing the raveling of a seam wherein a looper thread hanging hook for catching a looper thread which is allowed to pass through a loop of a needle thread immediately before the completion of a sewing operation and a driving mechanism of the hook together with a mechanism for cutting the looper thread and the needle thread are arranged on the right side of a needle drop point of a sewing machine.

10 Claims, 15 Drawing Sheets

APPARATUS FOR PREVENTING RAVELING OF SEAM

BACKGROUND OF THE INVENTION

The present invention relates to an apparatus for preventing the unraveling (also hereafter referred to as "raveling") of a seam at the end of sewing, the apparatus being provided in a sewing machine such as a double chain stitch sewing machine or a covering chain stitch sewing machine for sewing cloth with a looper thread and needle threads.

In a double-ring-sewing sewing machine or a flat-sewing sewing machine for sewing cloth by using needle threads and a looper thread, a loop of needle threads 6*a* and 6*b* and a looper thread 7 are intertwined in a form of another thread loop on a rear surface of a sewing cloth, so that a seam shown in FIG. 1A is formed. Such seam has a problem in that the looper thread 7 is pulled out from the final loops 6*c* and 6*d* by pulling the looper thread 7 cut at the end of the sewn portion, so that such pulling out progresses toward the start of sewing and the seam formed as shown in the drawing is raveled from the end of sewing.

In order to prevent such raveling of the seam, conventionally two methods have been generally used: a first method allows sewing in several stitches before the end by shortening the distance between seams on the sewing cloth or reducing the tension of the needle thread, so that the needle threads and the looper thread intertwine more easily between stitches near the end of sewing. A second method allows the needle thread to be tightened by increasing the tension of the looper thread next to the sewing cloth immediately before the end of the sewing.

However, there is a problem in the first method in that the seam in the vicinity of the end of sewing has a form different from the other portion thereof, or the seams look slack as a whole, so that the external appearance of the sewn product becomes poor and besides the needle threads and the looper thread are not necessarily intertwined as desired, so that a secure effect of preventing the raveling of the thread cannot be obtained. There is also a problem in the second method as well in that a wrinkle is generated on a sewn cloth in the vicinity of the end of sewing along with the tensioning of the needle thread, so that the external appearance becomes poor and a sufficient effect of preventing the raveling of the thread cannot be obtained.

Under these circumstances, the inventors of the present invention propose in Japanese Patent Publication No. 2879399 a method and an apparatus for preventing the raveling which provide a secured effect in preventing the raveling without the deterioration in the external appearance. The method and the apparatus are such that a looper thread hanger (a looper thread hanging hook) is provided for holding the looper thread, which is allowed to pass through the loop of the needle thread with the advance of the looper, on the side of the advancing end of the looper, the sewing operation is temporarily suspended with the looper being in the state of advancing, followed by catching the looper thread on the looper thread hanging hook so that one stitch is sewn in this state and the needle thread and the looper thread are cut.

According to this method, as shown in FIG. 1B, the looper thread 7 caught on the looper thread hanging hook remains in the form of another thread lacing on the final loops 6*c* and 6*d* of the needle thread 6*a,* 6*b* formed before the suspension of the sewing operation, and the looper thread 7 is not pulled out from the final loops 6*c* and 6*d* even when the end portion is pulled, with the result that the raveling of the seam can be prevented with certitude. Furthermore, as shown in the drawings the seam on the end portion of the sewing does to seem to be different from the other portion and the external appearance is not deteriorated.

In this manner, the method and the apparatus for preventing the raveling which are proposed in the Japanese Patent Publication No. 2879399 are excellent method and apparatus which can prevent the raveling of the thread generated on the seam at the end of the sewing in a sewing machine for sewing cloth by using a looper thread and needle threads such as the double-ring-sewing sewing machine, flat-sewing sewing machine or the like. The same method and apparatus are also disclosed in Japanese Patent Application Laid-Open No. HEI-910-225163, Japanese Patent Application Laid-Open No. HEI-11-57253, Japanese Patent Application Laid-Open No. HEI-11-57268 and Japanese Patent Application Laid-Open No. HEI-11-70281.

The apparatus conducting a method for preventing raveling of the seem as described above is constituted in such a manner that a looper thread hanging hook for catching the looper thread is arranged on the side of the advance end of the looper which advances from the right side of the needle drop point to the left side thereof, namely the rear side of the left of the needle drop point, so that an advance or retreat operation at the point or a swing operation around a vertical axis is conducted to catch the looper thread on the rear side of the looper.

However, for the arrangement of the looper thread hanging hook including a driving mechanism for the advance or retreat operation or a swing operation of the looper thread hanging hook, a large space is required on the left side of the needle drop point, namely, at the tip side of the sewing bed of the sewing machine. In particular, in a sewing machine provided with a small diameter cylinder-shaped bed for handling a cylindrically sewn product, the tip portion of the bed is extended for securing an arrangement space of the looper thread hanging hook, so that it is feared that the sewing operation is prevented.

BRIEF SUMMARY OF THE INVENTION

The present invention has been made in view of the above circumstances, and an object of the invention is to provide an apparatus for preventing the raveling of a seam, the apparatus realizing a method for preventing the raveling disclosed in the Japanese Patent Publication No. 2879399 without requiring a large arrangement space on the tip side of the sewing bed of a sewing machine by arranging a looper thread hanging hook and a driving mechanism thereof together with a cutting mechanism of the looper thread and the needle thread, on the right side of the needle drop point, the apparatus being applicable to a sewing machine provided with a cylindrical bed in which the arrangement space on the tip side is restricted.

According a first aspect of the present invention, there is provided an apparatus for preventing raveling of a seam, which is provided on a sewing machine for sewing a product by allowing a looper which advances from the right side to the left side of a needle drop point to pass through a loop of a needle thread formed at the needle drop point to force the looper thread held by the looper to twine around the needle thread, said apparatus comprising:

- a loop thread hanging hook arranged on the right rear side of the needle drop point to advance or retreat and catches the looper thread in the vicinity of the advance end of the looper at the time of the advance thereof;
- a needle thread cutting hook arranged on the right side of the needle drop point to advance ro retreat and catches the needle thread being inserted into the loop of the needle thread at the time of the advance thereof;

a needle thread knife slidably contacting the needle thread cutting hook at the time of the retreat of the hook, the knife cutting the needle thread which is caught at the time of the advance of the needle thread cutting hook;

a looper thread cutting hook arranged on the right side of the needle drop point to advance or retreat and catches the looper thread caught by the looper thread hanging hook at the time of the advance thereof;

a looper thread knife slidably contacting the looper thread cutting hook at the time of the retreat of the hook, the knife cutting the looper thread caught at the time of the advance of the loop thread cutting hook; and a looper thread cutting hook arranged on the right side of the needle drop point to advance or retreat and catches the looper thread caught by the looper thread hanging hook at the time of the advance thereof;

a looper thread knife slidably contacting the looper thread cutting hook at the time of th retreat of the hook, the knife cutting the looper thread caught at the time of the advance of the loop threat cutting hook; and means for controlling an operation of preventing the raveling of the seam, the mans causing the sewing machine to temporarily suspend the sewing operation before the end of the sewing in the state in which the looper advances followed by forcing the looper thread hanging hook to advance to catch the looper thread and then forcing the hook to retreat, then forcing the sewing machine to conduct the sewing operation for on stitch in this state, which is then followed by forcing the needle thread cutting hook and the looper thread cutting hook to advance and retreat thereby cutting the needle thread and the looper thread with the needle thread knife the looper thread knife respectively.

In the first aspect of the present invention, the looper thread hanging hook arranged at the rear side of the right of the needle drop point is forced to advance and is operated to catch the looper thread at the rear side of the looper which exists at the advance end, so that the sewing machine is forced to conduct one stitch sewing operation followed by forcing the needle thread cutting hook and the looper thread cutting hook arranged on the right rear side of the needle drop point to advance thereby the needle thread cutting hook being inserted into the loop of the needle thread. This allows the looper to pass therethrough to catch the needle thread, and the looper thread cutting hook catching the looper thread held on the looper thread hanging hook so that the needle thread knife and the looper thread knife are forced to slidably contact the hooks to cut the threads respectively at the time of the retreat of the both hooks thereby preventing the raveling.

In the first aspect of the present invention, the looper thread hanging hook for temporarily holding the looper thread immediately before the end of sewing is arranged on the right side of the needle drop point together with the needle thread cutting hook and the looper thread cutting hook in order to prevent the raveling. Since these hooks and the driving mechanism are arranged on the right side of the needle drop point, the prevention of the raveling can be realized without the need of a large space at the tip side of the sewing bed. Thus, the first aspect of the invention can be applied irrespective of the kind of sewing machines, such as a sewing machine provided with a cylindrical bed in which the arrangement space on the tip side thereof is restricted. As a result raveling of the seam can be prevented in a simple operation, no wrinkle is generated on the sewn cloth, and there is no deterioration of the external appearance, even with an unusual state of the seam.

Furthermore, according to a second aspect of the invention, the apparatus for preventing the raveling of the seam according to claim 1, further comprises a looper thread holding hook continuously provided at the tip portion of the needle thread cutting hook for catching the looper thread in the vicinity of the advance end of the looper at the time of the advance of the needle thread cutting hook, pulling out the caught looper thread from the final loop of the needle thread at the time of the retreat of the needle thread cutting hook after the advance, to hold the looper tread in front of the needle knife.

In the second aspect of the invention, when the needle thread cutting hook advances to be inserted into the loop and catches the needle thread, the looper thread holding hook which is continuously provided at the end of this needle thread cutting hook catches and holds the looper thread in the vicinity of the end of the looper, namely, at the side of the looper rather than at the cutting position by the looper thread cutting hook, with the result that the disposition of the looper thread becomes unnecessary at the time of the start of the next sewing operation.

Furthermore, according to a third aspect of the invention, the apparatus for preventing the raveling of the seam according to claim 2, further comprises thread pulling back means for pulling back the looper thread before the supply to the looper in order to shorten the hanging length of the looper thread caught by the looper thread holding hook.

In the third aspect of the invention, the looper thread ahead of the supply to the looper is pulled back, the length of the looper thread held on the looper thread holding hook is shortened, and the accompanying of the long looper thread on the sewing start portion at the time of the next sewing operation is prevented, with the result that disposal of the looper thread is unnecessary.

Furthermore, according to a fourth aspect of the invention, the apparatus for preventing the raveling of the seam according to claim 3, further comprises:

a looper thread guide for holding the looper thread before the supply to the looper so as to cross the advance and retreat path of the needle thread cutting hook; and a thread hooking portion provided on the needle cutting hook or on a part of an attachment base thereof to hook the looper thread held along the looper thread guide at the time of the retreat of the needle thread cutting hook.

In the fourth aspect of the present invention, a thread hanging portion is provided on the needle thread cutting hook integrally with the looper thread holding hook or on a part of the holder of this needle thread cutting hook, and by utlizing the ratreat motion of the needle thread cutting hook for cutting the needle thread, the looper thread held along the looper thread guide so as to cross the retreat path during this motion is caught by the needle hooking portion and is pulled back thereby shortening the length of the looper thread held on the looper thread hook.

In the fourth aspect of the invention, the length of the looper thread held on the looper thread holding hook can be shortened without using a special apparatus thereby making it possible to prevent the deterioration in the external appearance with a simple structure.

The above and further objects and features of the invention will more fully apparent from the following detailed description with accompanying drawings.

DETAILED DESCRIPTION OF THE INVENTION

Figure 2:
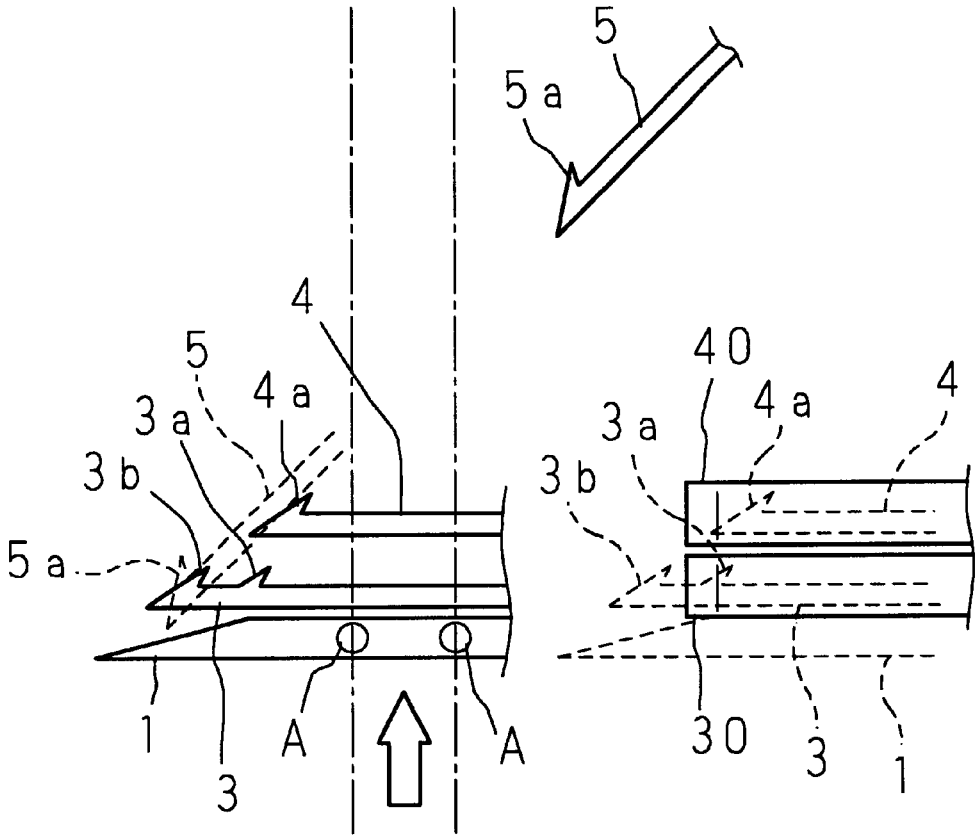
FIG. 2 is a plan view schematically showing a structure of an apparatus according to the present invention.

FIG. 2 is a plan view schematically showing a structure of an apparatus for preventing the raveling according to the present invention (hereinafter referred to as the apparatus of the invention).

The apparatus of the present invention is provided in a sewing machine for sewing cloth (not shown) which is fed forward or backward as shown by a white arrow in FIG. 2 with two needles 2 and 2 (refer to FIGS. 5 through 8), which drop to the needle drop points shown by symbols A and A respectively, and the looper 1, which advances and retreats along the path including the needle drop point in the midst thereof.

The looper 1 is constituted in such a manner that the tip end of the looper 1 is forced to advance or retreat between a left advance position where the tip end advances over the needle drop points A and A to one side thereof as shown by a solid line in FIG. 2 and a right retreat position where the tip end thereof retreats over the needle drop points A and A to another side thereof as shown by a dotted line in the same manner.

On an upper portion of the looper 1 described above, a needle thread cutting hook 3 is arranged in such a manner that the needle thread cutting hook 3 can advance or retreat approximately in the same direction as the looper 1. On the rear side of the needle thread cutting hook 3, a looper thread cutting hook 4 is arranged in such a manner that the hook 4 can advance or retreat approximately in the same direction as the looper 1. At the rear side of the looper thread cutting hook 4, the looper thread hanging hook 5 having the tip end directed in a diagonally forward direction is arranged in such a manner that the hook 5 can advance or retreat in a longitudinal direction.

On the halfway portion of the needle thread cutting hook 3, a hook-shaped needle thread fluke 3*a* for hanging the needle thread projects diagonally backward. On the tip end side of the projecting position, a hook-shaped looper thread fluke (a looper thread holding hook) 3*b* also projects diagonally backward in a similar manner. Furthermore, at the tip end portion of the looper thread cutting hook 4, and at the tip end portion of the looper thread hanging hook 5, hook-shaped looper thread flukes 4*a* and 5*a* project diagonally backward respectively.

Furthermore, attached to the needle thread cutting hook 3 and a looper thread cutting hook 4 are a needle thread cutting knife 3*a* and a looper thread cutting knife 3*a* and a looper thread cutting knife each having an edge at the tip thereof, both knifes slidably coming into contact, from above, with base portions of the hooks 3 and 4, respectively. The needle thread cutting hook 3 is constituted in such a manner as to be forced to advance or retreat between a retreat position and an advance position. At the retreat position, the needle thread fluke 3*a* in the midst overlaps a lower portion of the needle thread knife 30 the looper thread fluke 3*b* at the tip end projects by an appropriate length from the edge portion at the tip of the needle thread knife 30 as shown by a dotted line with respect to the needle thread knife 30. At the advance position, the needle thread fluke 3*a* and a looper thread fluke 3*b* somewhat project from the edge portion at the tip of the needle thread knife 30 as shown by a solid line in the drawings. So, the advance end of the needle thread cutting hook 3 attains a portion in the vicinity of the tip of the looper 1 located at the left advance position, and, as described later, the needle thread fluke 3*a* catches the loop of the needle thread formed at the needle drop point A and A, and the looper thread fluke 3*b* catches the looper thread on the rear side of the looper 1.

Furthermore, the looper thread cutting hook 4 is constituted in such a manner as to be forced to advance or retreat between a retreat position and an advance position. In the retreat position, the looper thread fluke 4*a* at the tip end overlaps the lower portion of the looper thread knife 40 as shown by a dotted line in a drawing. In the advance position, the looper thread fluke 4*a* projects by a predetermined length from the edge portion at the tip of the looper knife 40. So, the advance end of the looper thread cutting hook 4 attains a portion in the vicinity of the tip of the looper 1 along the rear side of the looper 1 located at the left, and the looper thread caught by the looper thread fluke 4*a* as described later.

Furthermore, the looper thread hanging hook 5 is constituted in such a manner as to be forced to advance or retreat between a retreat position and an advance position. In the retreat position, the hook is positioned in a right backward direction from the needle drop points A and A as shown by the solid line in the drawing. In the advance position, the hook is forced to advance in a left forward direction by diagonally crossing the rear side of the needle drop points A and A as shown by a dotted line in the drawing. The looper thread fluke 5*a* at the tip of the looper thread hanging hook 5 is constituted in such a manner as to come close to the rear surface of the looper 1 located at the left advance position when the hook 5 is at the advance position, to catch the looper thread 7 on the side of the advance end of the looper 1 as will be described later.

In the apparatus of the present invention, the needle thread cutting hook 3, the looper thread cutting hook 4 and the looper thread hanging hook 5 which are constituted as described above are forced to advance or retreat as will be described later thereby conducting an operation of preventing the raveling at the end of the sewing of the seam which is formed on the sewn cloth not shown by an operation of the looper 1 and needles 2 and 2. The needle thread cutting hook 3, the looper thread cutting hook 4 and the looper thread hanging hook 5 are all arranged on the right side of the needle drop points A and A, so that it is not required to secure an arrangement space for each of the hooks 3, 4, 5 and their driving mechanism (an air cylinder or the like) on the left side of the needle drop points A and A, namely, on the tip side of a sewing bead B (see FIG. 13), and it is also possible to apply the apparatus to a sewing machine provided with a cylindrical bed having a small diameter.

Figure 3:
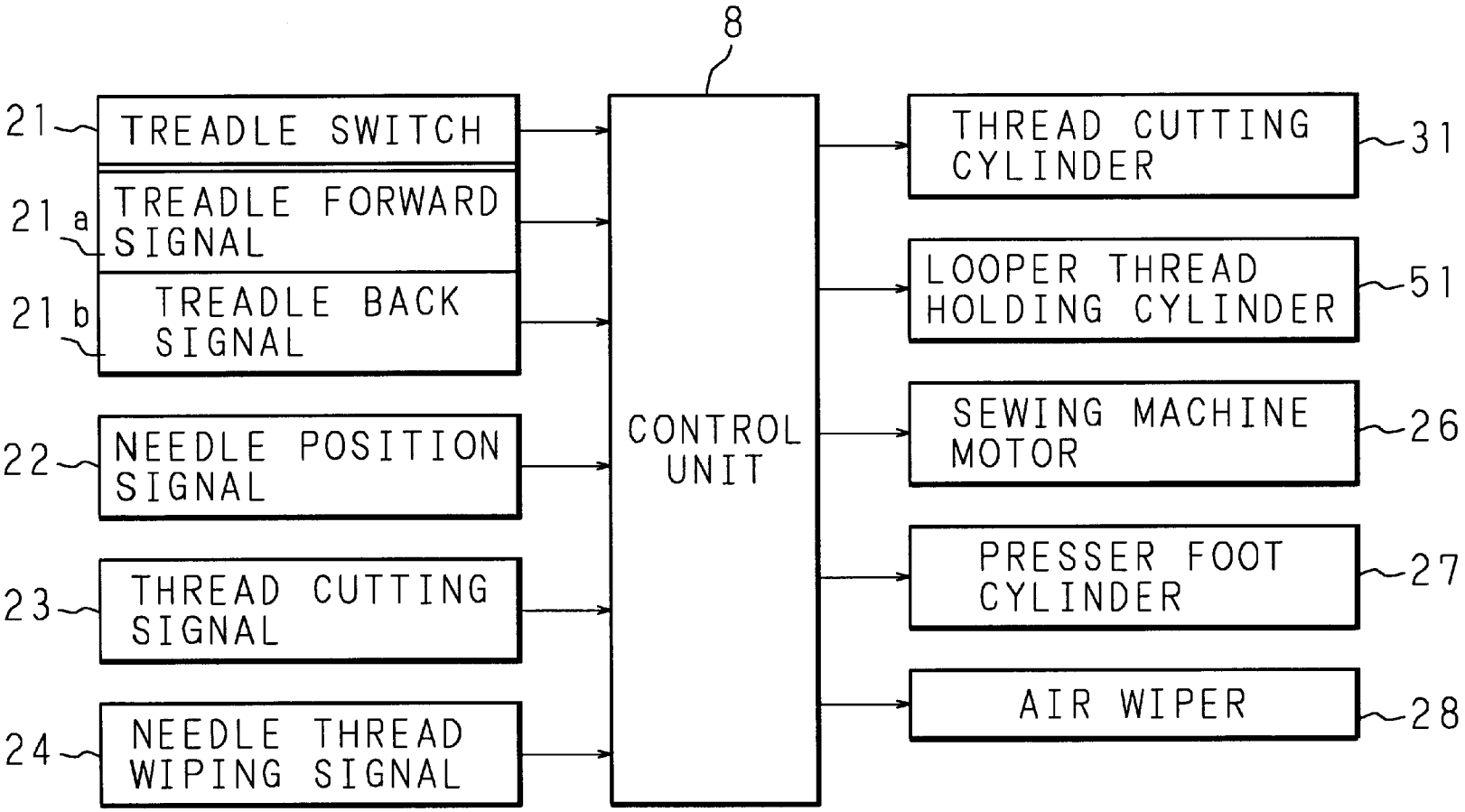
FIG. 3 is a block diagram showing a control system of a sewing machine provided with an apparatus of the present invention.

FIG. 3 is a block diagram showing a control system of a sewing machine provided with the apparatus of the present invention. To a control unit 8 including a microprocessor there are input a step-in signal 21*a* and a step-back signal 21*b* generated by a treadle switch 21, a needle drop point signal 22 obtained at the time when the needle is located in the vicinity of top dead point, as well as a thread cutting signal 23 and a needle thread wiping signal 24.

On the other hand, an output of the control unit 8 is provided respectively, to a thread cutting cylinder 31 for forcing a needle thread cutting hook 3 and the looper thread cutting hook 4 constituting the apparatus of the invention to advance or retreat. A looper thread holding cylinder 51 for forcing the looper thread hanging hook 5 to advance or retreat, and the needle thread cutting hook 3, the looper thread cutting hook 4 and the looper thread hanging hook 5 are constituted to be forced to advance or retreat in accordance with an operation instruction from the control unit 8 to each of the cylinders 31 and 51. Though, in FIG. 3, the apparatus of the present invention is constituted in such a manner that the advance or retreat operation of the needle thread cutting hook 3 and the looper thread cutting hook 4 are conducted at the same time with a single cylinder (the thread cutting cylinder 31), the advance or retreat operation of both hooks 3 and 4 may be forced to be conducted separately with respective cylinders.

Furthermore, an output from the control unit 8 is also provided to a motor 26 of the sewing machine which constitutes a drive source of the main axis of the sewing machine, a presser foot cylinder 27 for allowing up and down movement of presser foot plate for pressing the cloth, and to an air wiper 28 for wiping out the needle thread cut as described later. The motor 26 of the sewing machine is constituted to rotate or stop in accordance with an operation instruction given from the control unit 8. The presser foot cylinder 27 and air wiper 28 are constituted to be forced to operate in accordance with an operation instruction from the control unit 8.

Figure 4:
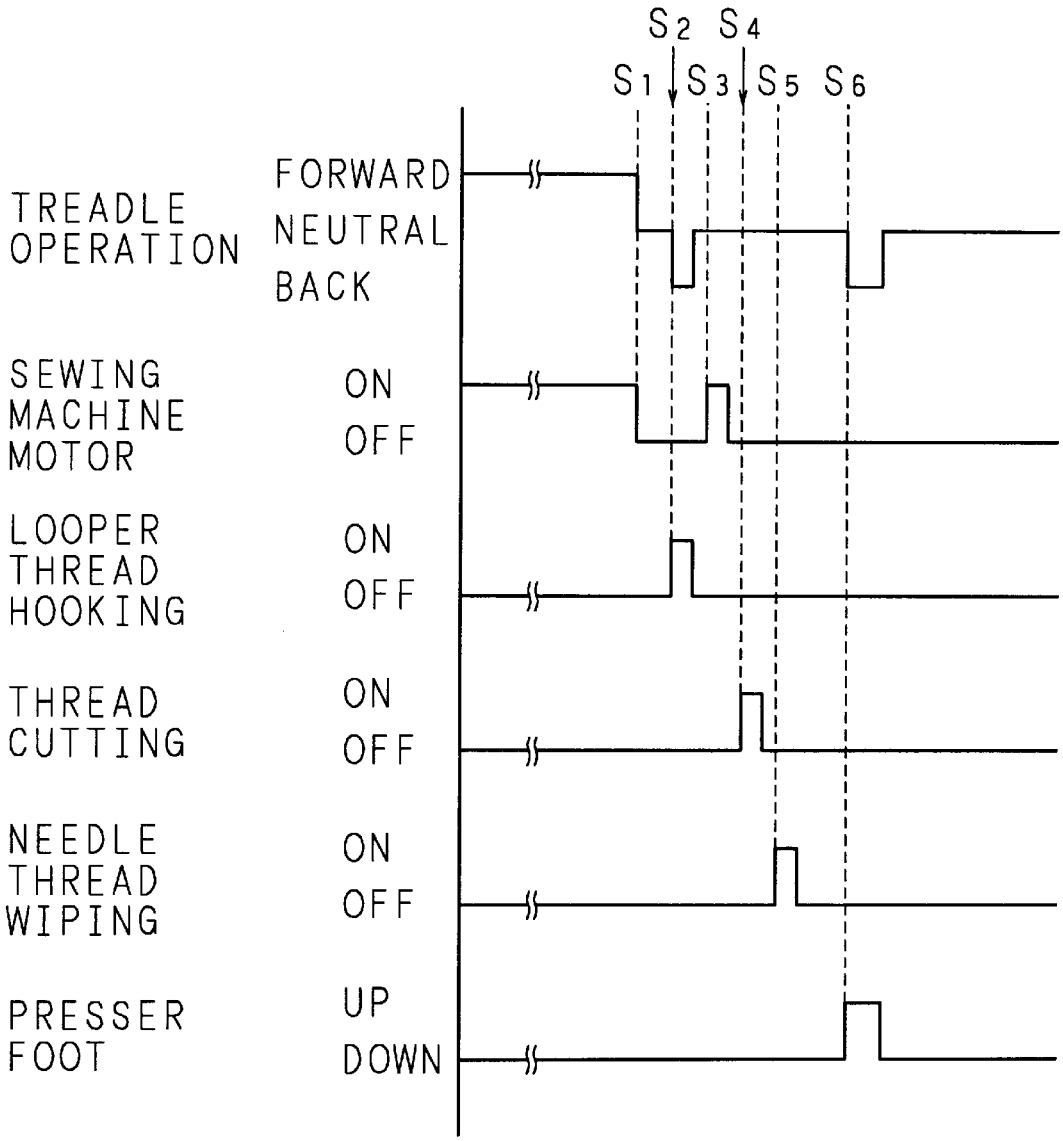
FIG. 4 is a timing chart showing an operation sequence of a control unit.

FIG. 4 is a timing chart showing an operation sequence of the operation of the control unit 8, the operation being conducted for preventing the generation of the raveling at the end of the sewn portion of the sewn cloth. FIGS. 5 through 8 are views for explaining an operation of the apparatus of the present invention, the views showing the operation state of the needle thread cutting hook 3, the looper thread cutting hook 4 and the looper thread hanging hook 5 during the operation of the control unit 8 in accordance with the timing chart of FIG. 4.

When the sewing operation is completed up to the predetermined position with respect to the sewn cloth, and the treadle for driving the sewing machine is brought back to the neutral state from the treadle forward state, in other words, when neither the treadle forward signal 21*a* nor the treadle back signal 21*b* is given to the input side, the control unit 8 issues a suspension instruction to the sewing machine on the output side by referring to the needle position signal 22 given to the input side, so that the sewing machine is temporarily suspended in the state in which the needles 2 and 2 are located in the vicinity of the top dead point and the looper 1 is forced to advance in the left direction.

Thereafter, the control unit 8 waits until the treadle is back. At the time S2 of FIG. 4, the treadle back operation is conducted thereby initiating the operation of preventing the raveling of the seam depending on the treadle back signal 21*b* given to the input side as a trigger. In the beginning, an operation instruction is issued to the looper thread holding cylinder 51 on the output side forcing the looper thread hanging hook 5 to advance or retreat at a predetermined stroke.

Figure 5:
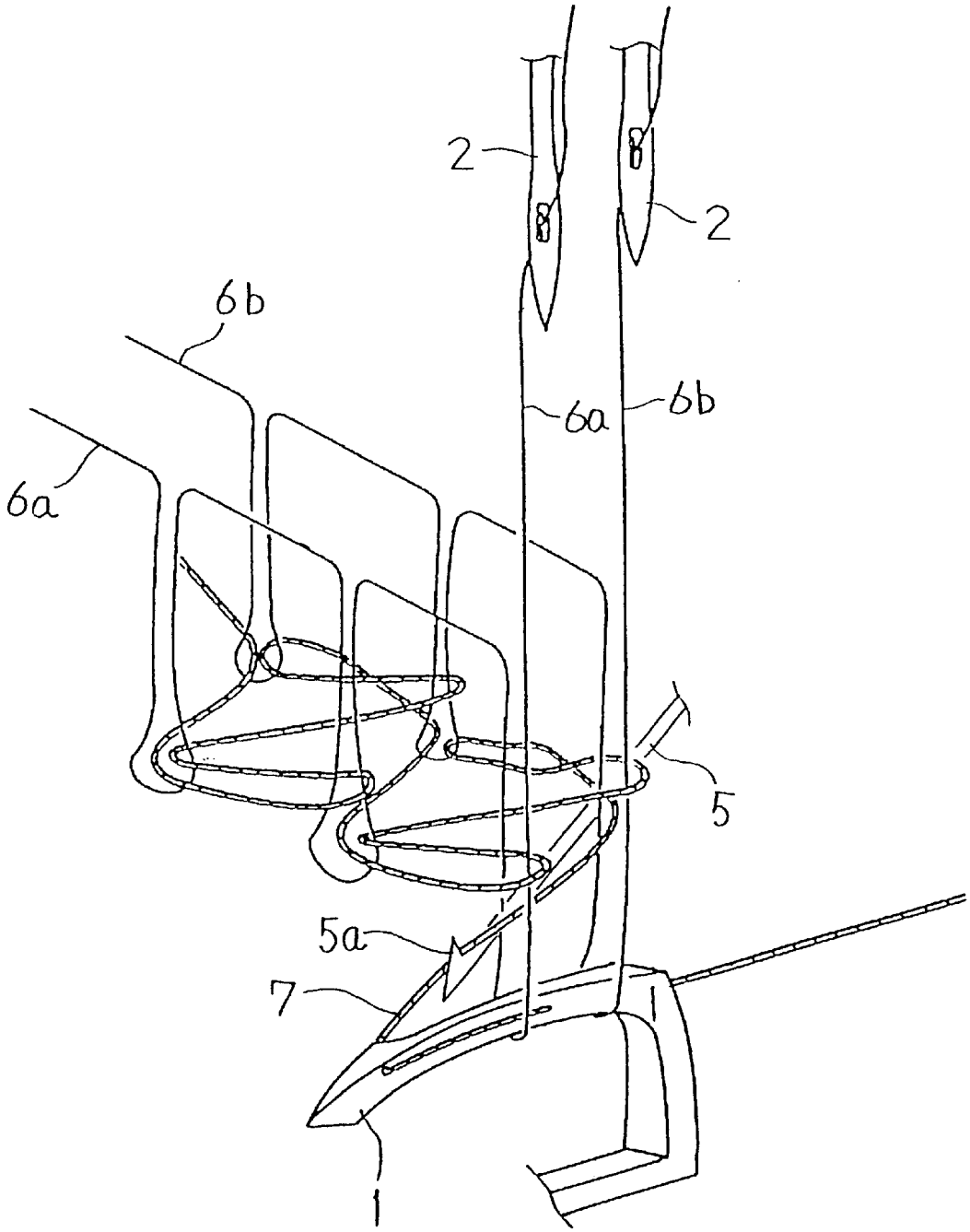
FIG. 5 is a view for explaining an operation of the apparatus of the present invention.
Figure 6:
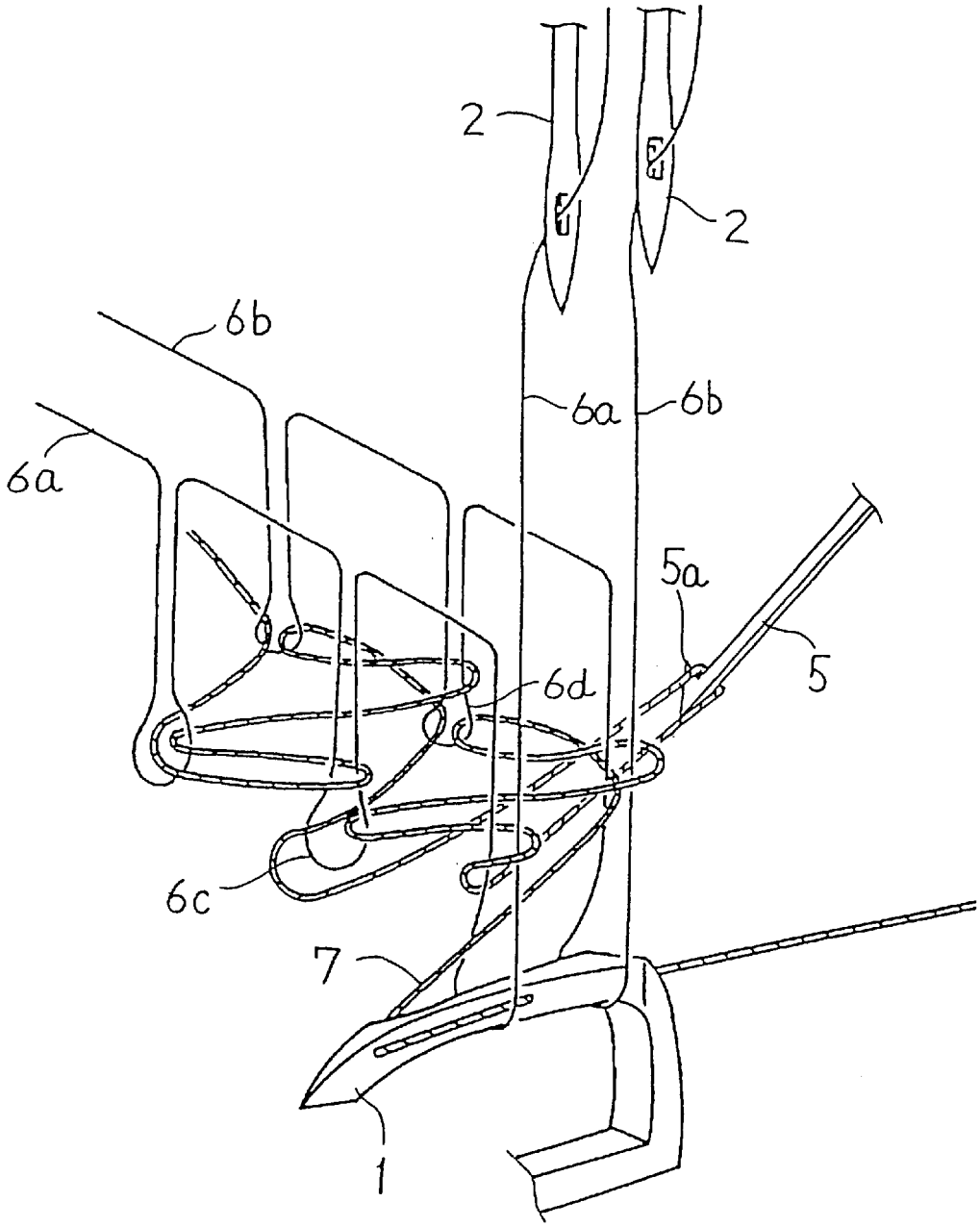
FIG. 6 is a perspective view showing the operation state of the apparatus of the present invention.

As a result, the looper thread hanging hook 5 comes close to the rear surface of the looper 1 at the time of advance to catch the looper thread 7, and the caught looper thread 7 is pulled back to the retreat position with the retreat of the looper thread hanging hook 5 which is subsequently conducted as described above. FIG. 5 shows a state in which the looper thread 7 is caught by the looper thread fluke 5*a* at the tip of the looper thread hanging hook 5 which has advanced.

After the looper thread hanging hook 5 is forced to advance and retreat as described above, the control unit 8 issues an operation instruction to a sewing machine motor 26 while referring to the needle position signal 22 at the time S3 of FIG. 4 to sew the cloth not shown for one stitch. In the state in which the needles 2 and 2 are located in the vicinity of the top dead point, and the looper 1 advances in the left direction, the sewing machine is suspended again. At this time, while the looper thread 7 passing through the final loops 6*c* and 6*d* of the needle threads 6*a* and 6*b* formed before the first suspension of the sewing machine is held in the looper thread hanging hook 5, the one stitch of the sewing operation is conducted, so that the needle threads 6*a* and 6*b* and the looper thread 7 are set in the state shown in FIG. 6.

Next, the control unit 8 waits until the thread cutting signal 23 is given. When the thread cutting signal 23 is given at the time S4 of FIG. 4, the control unit issues an operation signal to the thread cutting cylinder 31 on the output side thereby forcing the thread cutting cylinder 31 to advance or retreat at a predetermined stroke. With this advance or retreat operation, the thread cutting hook 3 and the looper thread cutting hook 4 attain respective advance positions which have been set as described above and return to the retreat position after that.

Figure 7:
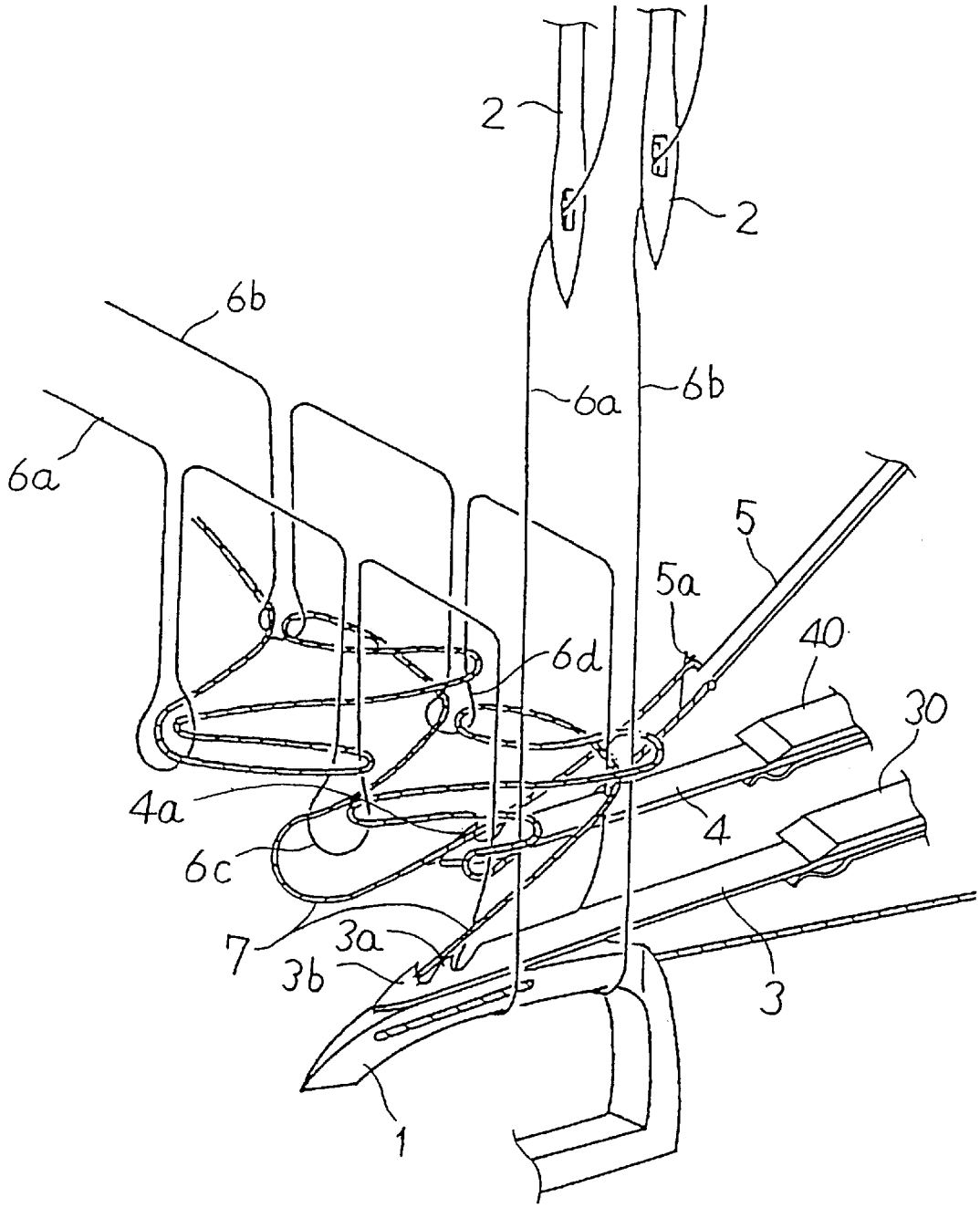
FIG. 7 is a perspective view showing the operation state of the apparatus of the present invention.

FIG. 7 shows a state in which the needle thread cutting hook 3 and the looper thread cutting hook 4 have attained respective advance positions. The needle thread cutting hook 3 which has advanced is inserted along the upper portion of the looper 1 into the loop of the needle threads 6*a* and 6*b* formed with the sewing operation for one stitch. So, the needle thread fluke 3*a* projectingly provided on the halfway portion faces the needle thread 6*a* on the left side and the looper thread fluke 3*b* projectingly provided at the tip portion faces the looper thread 7 extending in a diagonally backward direction at the rear surface of the tip portion of the looper 1. The following retreat operation of the needle thread cutting hook 3 causes the needle threads 6*a* and 6*b* to be caught at one time, and the looper thread 7 is caught by the looper thread fluke 3*b* at the position close to the rear surface of the looper 1.

Furthermore, the looper thread cutting hook 4 advances approximately in parallel with the needle cutting hook 3 between the loops of the needle threads 6*a* and 6*b* formed in the one-stitch sewing operation and the final loops 6*c* and 6*d* as shown in the drawing. At this time, the looper thread fluke 4*a* projectingly provided at the tip thereof faces the looper thread 7 caught by the looper thread hanging hook 5. With the subsequent retreat operation of the looper thread cutting hook 4, the looper thread 7 is caught by the looper thread fluke 4*a* on the side farther from the catching position by the looper thread fluke 3*b,* namely, on the side near the sewn cloth.

As has been described above, the needle threads 6*a* and 6*b* caught by the needle thread cutting hook 3 as well as the looper thread 7 caught by the looper thread cutting hook 4 are pulled toward the retreat positions of the respective hooks 3 and 4. At this time, the needle threads 6*a* and 6*b* are allowed to slidably contact the needle thread knife 30 to be cut at the catching position by the needle thread fluke 3*a,* and the looper thread 7 is allowed to slidably contact the looper thread knife 40 to be cut at the catching position by the looper thread fluke 4*a.* At the same time, the looper thread 7 is held to the looper 1 rather than the cutting position by the looper thread fluke 3*b* which remains in a projecting state from the edge portion at the tip of the needle knife 30 at the retreat position.

Figure 1A:
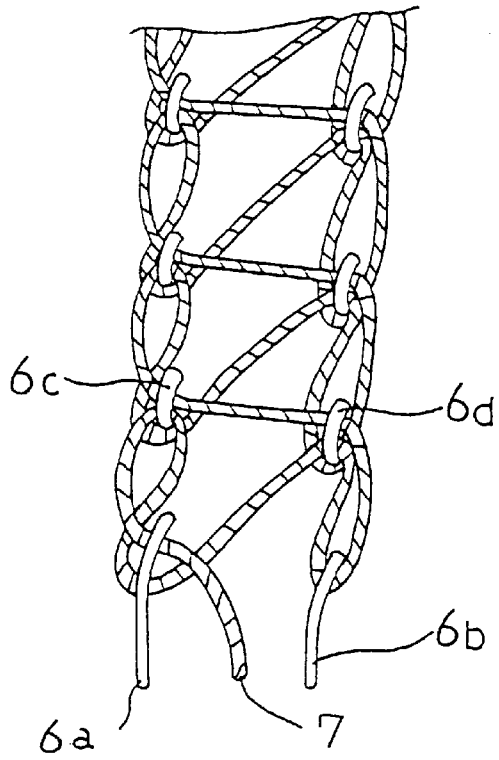
FIG. 1A PRIOR ART
FIGS. 1A and 1B are views showing a seam at the end portion of the sewing as seen from the rear surface of the sewn cloth.
Figure 1B:
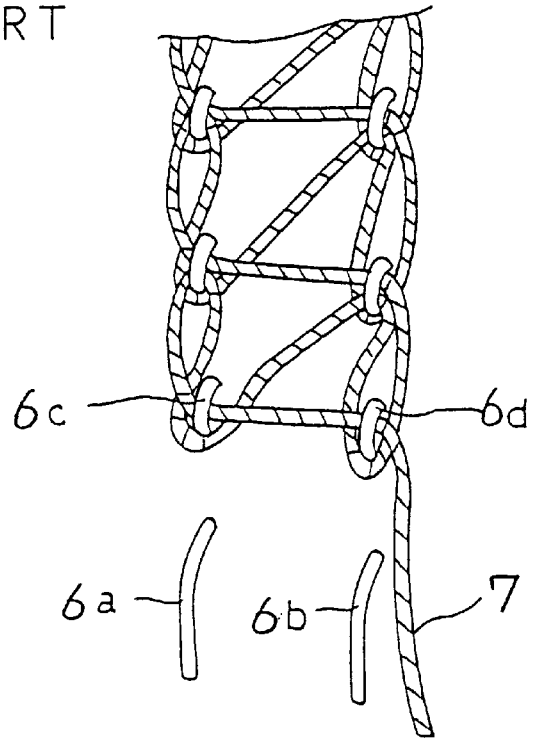
FIG. 1B PRIOR ART
Figure 8:
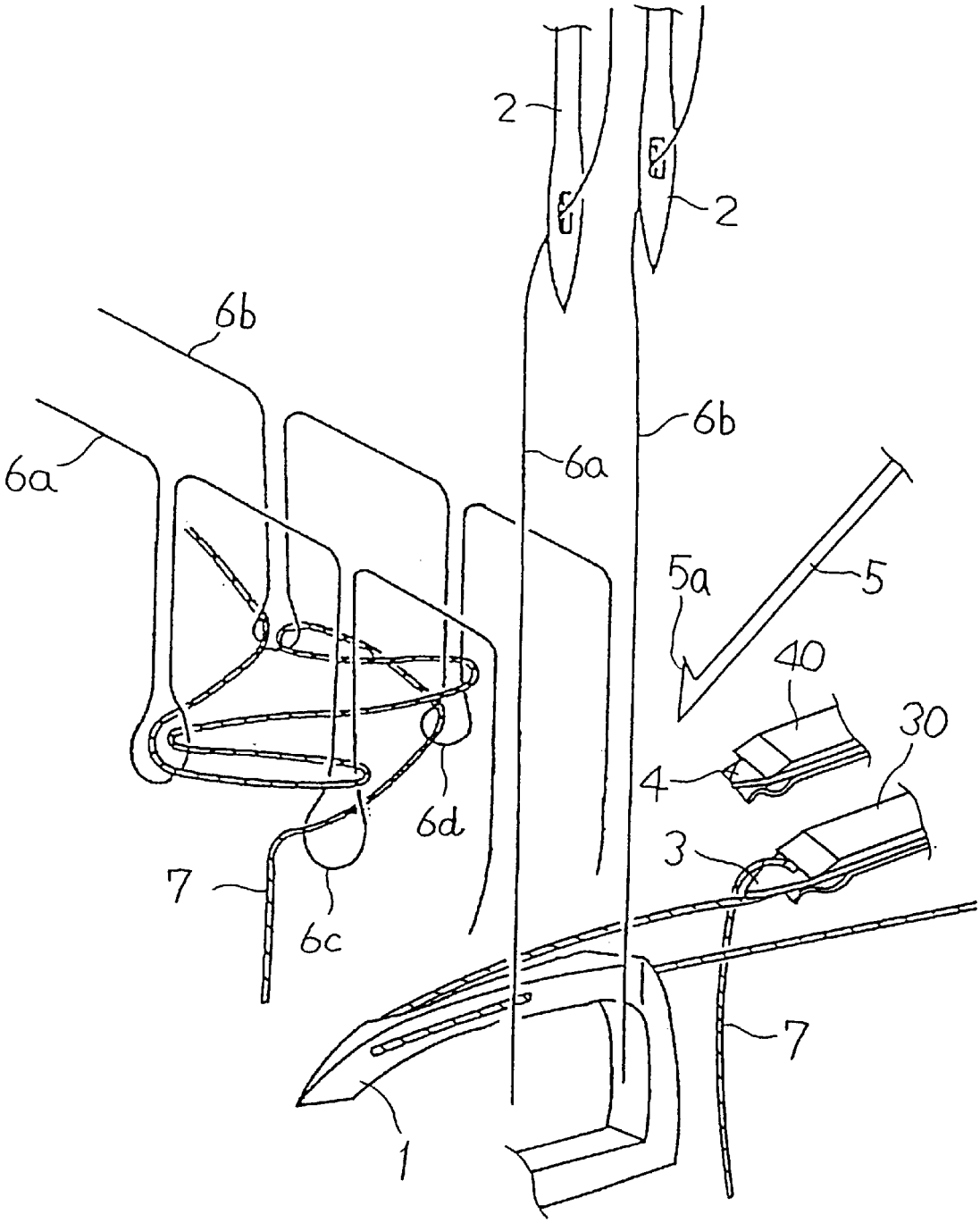
FIG. 8 is a perspective view showing the operation state of the apparatus of the present invention.

FIG. 8 shows the state at this time. The looper thread 7 which is cut as described above remains in a form of other thread lacing in the final loops 6*c* and 6*d* of the needle threads 6*a* and 6*b* formed before the first suspension of the sewing machine, so that the seam at the end of the sewing operation as shown in FIG. 1B is formed. The looper thread 7, which is allowed to pass through the final loops 6*c* and 6*d* in this manner does not slip out even if the end thereof is pulled. Thus, the raveling of the seam can be prevented securely, and the seam at the end of the sewing operation which can be obtained in this manner is not different from that on other portions in external appearance, so that the external appearance thereof is not deteriorated.

After the cutting operation is completed in this manner, the control unit 8 waits until the needle thread wiping signal 24 is given. When the needle thread wiping signal 24 occurs at the time $S_5$ of FIG. 4, an operation signal is given to the air wiper 28 on the output side to activate the air wiper 28 to wipe out the needle threads 6*a* and 6*b* which remain on the side of the needles 2 and 2 onto the sewing bed of the sewing machine thereby completing a series of operations for preventing the raveling of the seam.

Thereafter, the control unit 8 waits until the treadle is forced to be treadled back and operated again. When the treadle back operation is conducted and the step-back operation signal is input to the input side at the time $S_6$ of FIG. 4, the control unit 8 issues an operation instruction to the presser foot cylinder 27 on the output side to operate the presser foot cylinder 27 and to raise a presser foot for pressing the cloth. As a consequence, the sewn cloth is taken out of the sewing machine, and it also becomes possible to set a new cloth to be sewn. The looper thread 7 which is consecutive the sewn cloth is removed from the looper thread hanging hook 5 along with the removal of the cloth, with the result that the looper thread remains on the sewn cloth in the state shown in FIGS. 8 and 1B.

At this time, the looper thread 7 which remains on the looper 1 is held under the sewing bed of the sewing machine by the looper thread fluke (looper thread holding hook) 3*b* at the tip of the needle thread cutting hook 3. Furthermore, the needle threads 6*a* and 6*b* which remain on the needles 2 and 2 are wiped up onto the sewing bed of the sewing machine. Consequently, it is possible to start the next sewing operation without causing any trouble of dealing with these needle threads 6*a* and 6*b* and the looper thread 7.

Though, in the above embodiments, it is possible to attain a main object of preventing the raveling of a seam at the end of the sewing operation, the looper thread 7 cut as has been described above remains in a state of dangling long from the looper thread fluke 3*b* at the tip of the needle thread cutting hook 3 so that there is a disadvantage in that the external appearance is deteriorated in accompaniment of this looper thread 7 with the portion at which the next sewing operation is started.

Figure 9:
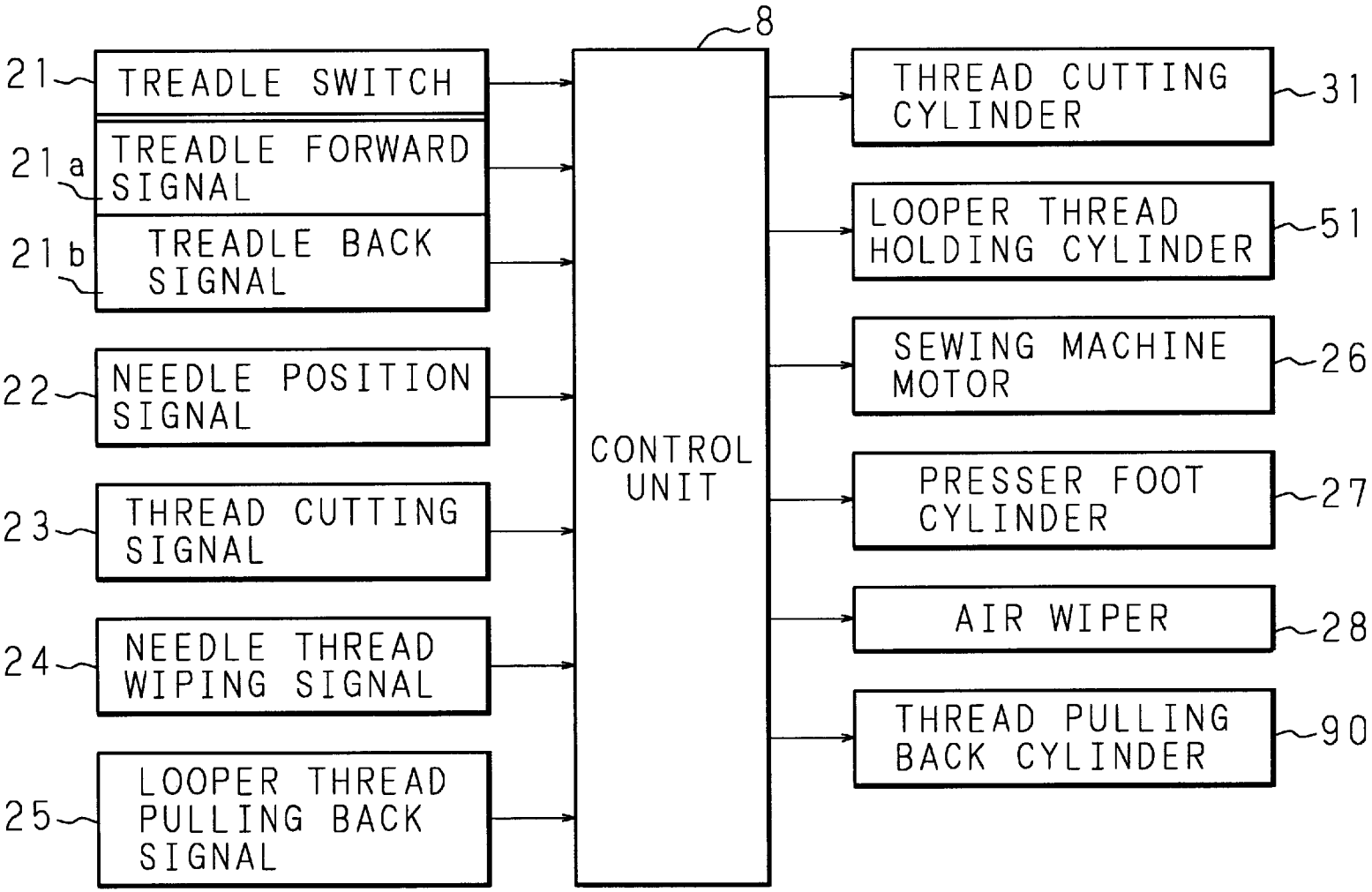
FIG. 9 is a block diagram showing another embodiment of the control system of the sewing machine provided with the apparatus of the present invention.
Figure 10:
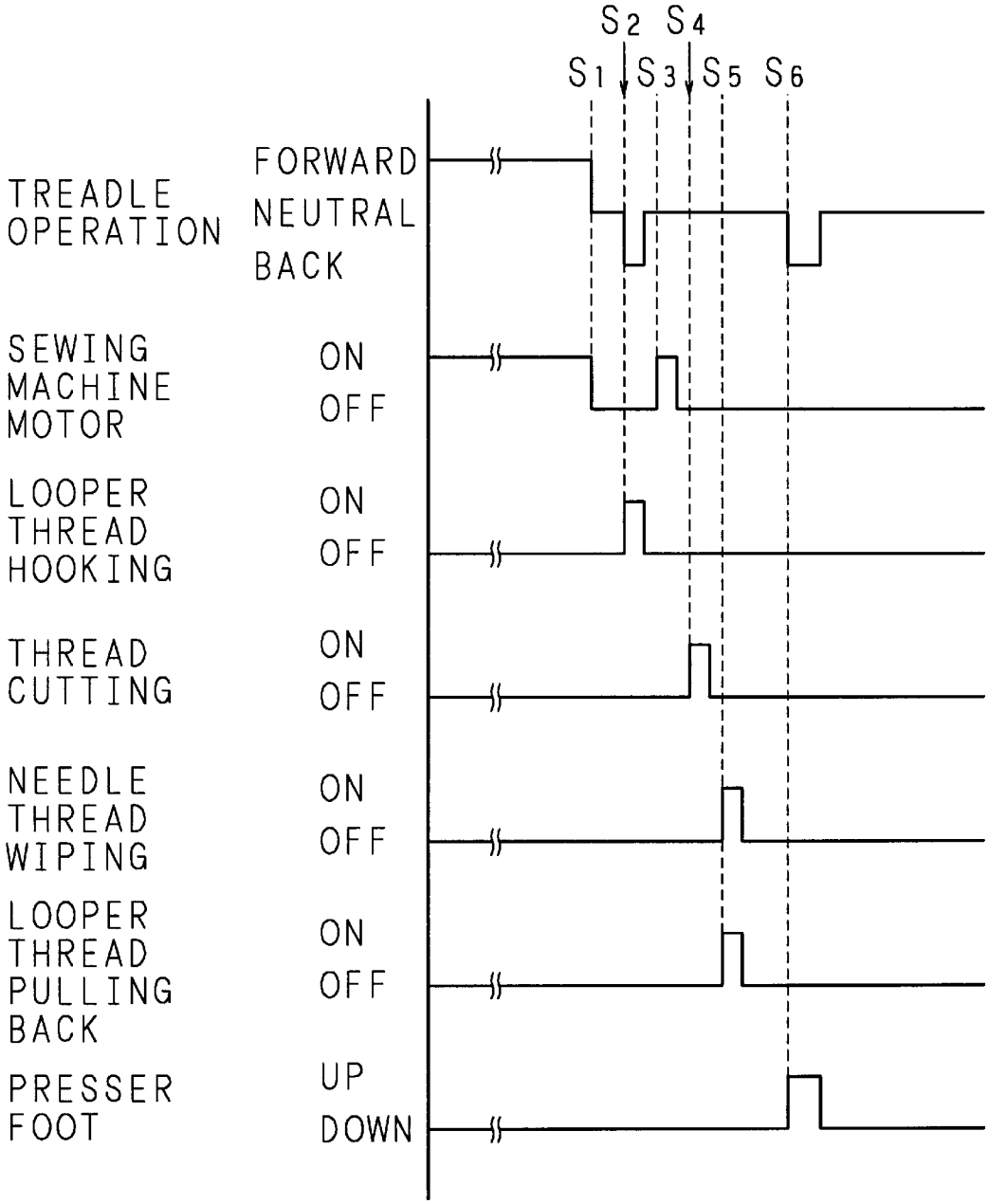
FIG. 10 is a timing chart showing an operation sequence of a control unit shown in FIG. 9.
Figure 11:
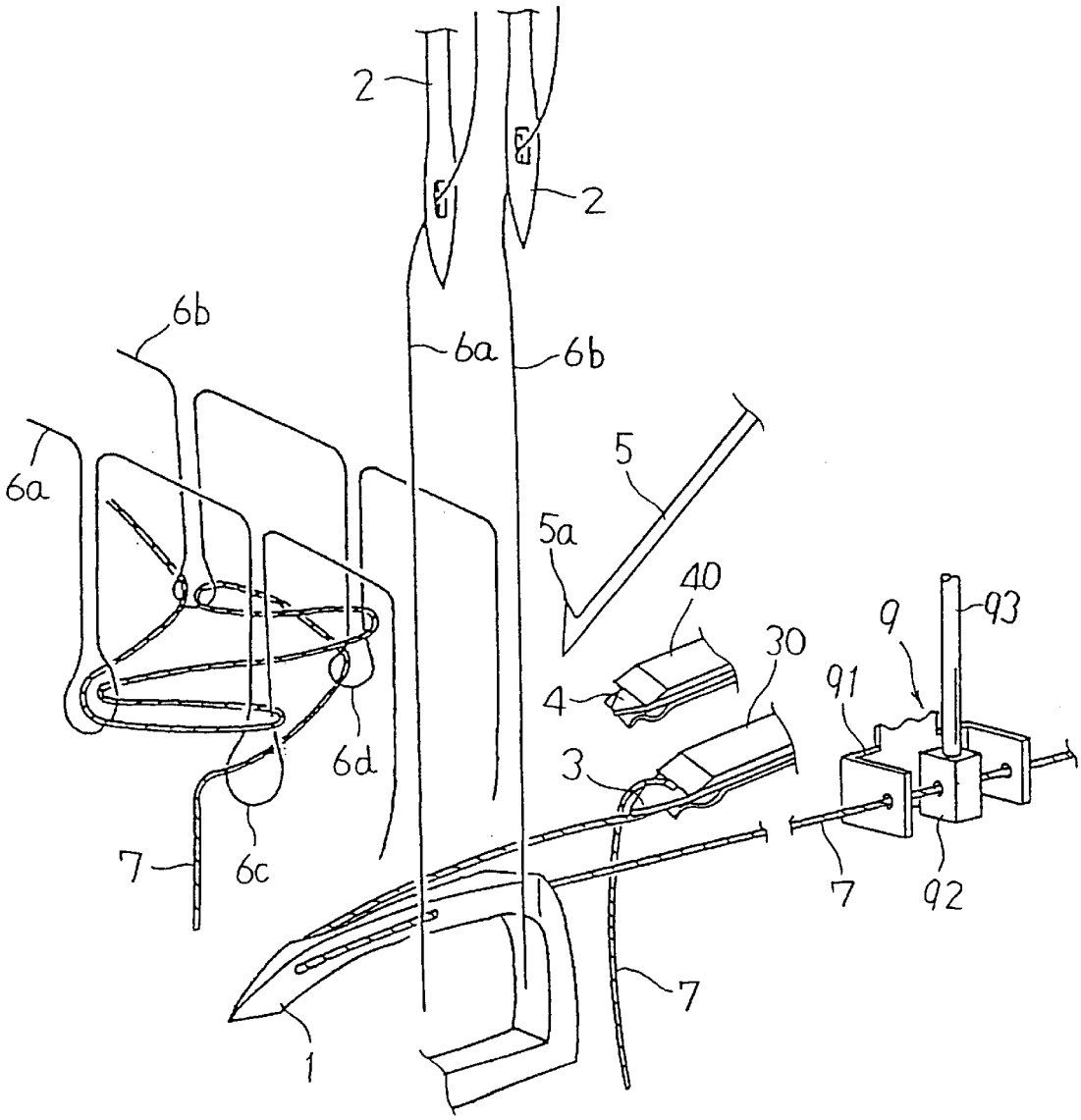
FIG. 11 is a view of explaining an operation of the apparatus shown in FIG. 9.
Figure 12:
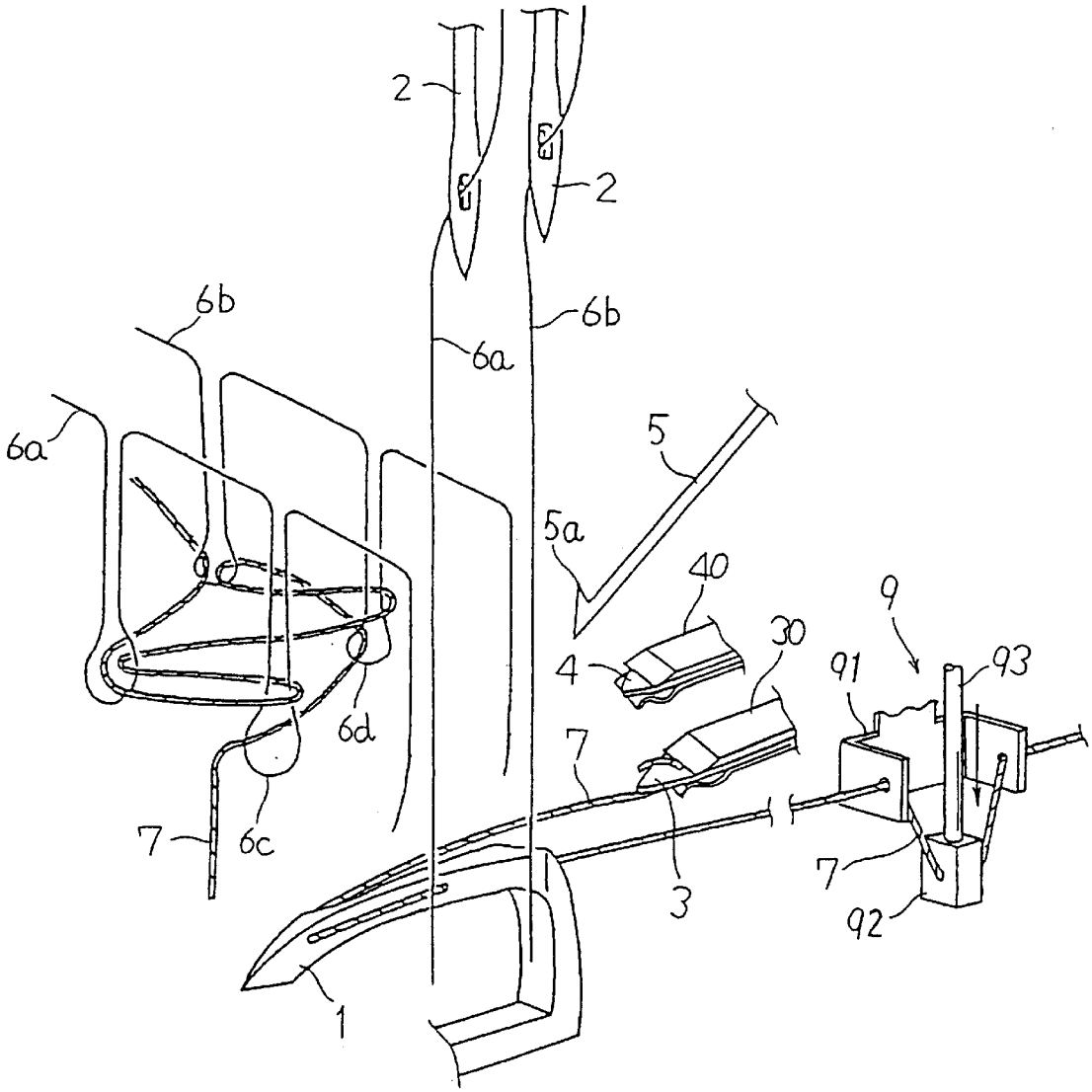
FIG. 12 is view of explaining an operation of the apparatus shown in FIG. 9.

FIGS. 9 through 12 are views showing embodiments in which an attempt is made to solve the above disadvantage. FIG. 9 is a block diagram showing a control system of the sewing machine provided with the apparatus according to the embodiments. FIG. 10 is a timing chart showing an operation sequence of the control unit. FIGS. 11 and 12 are views for explaining the operation thereof.

In FIG. 9, to the control unit 8 including a microcomputer, there are input: the step-in signal 21*a* and the step-back signal 21*b* generated by the treadle switch 21, the needle position signal 22 obtained when the needles are located in the vicinity of the top dead point, the needle thread cutting signal 23 and the needle thread clear signal 24, similar to the control unit 8 shown in FIG. 3. In addition to these signals, a looper thread pulling back signal 25 generated with the thread pulling back switch is input thereto.

On the other hand, the output of the control unit 8 is provided to the thread cutting cylinder 31, the looper thread holder cylinder 51, the sewing machine motor 26, the presser foot cylinder 27 and the air wiper 28 respectively in the same manner as the control unit 8 shown in FIG. 3. At the same time, the output thereof is given to the thread pulling back cylinder 90 for an operation of the looper thread pulling back device 9 which is constituted in as described later. The looper thread pulling back cylinder 90 is constituted in such a manner that the cylinder 90 is operated in accordance with the operation instruction from the control unit 8.

When the control unit 8, which is constituted as described above complete the sewing operation up to the predetermined position with respect to the sewn cloth not shown and the treadle for the driving of the sewing machine is brought back from the step-in state to the neutral state at the time $S_1$ of FIG. 10, a suspension instruction is issued to the motor 26 of the sewing machine on the output side by referring to the needle position signal 22 given to the input side, thereby temporarily suspending the sewing machine in the state in which the needles 2 and 2 are located in the vicinity of the top dead point and the looper 1 has advanced in left direction.

Next, the control unit 8 initiates an operation of preventing the raveling of the seam depending on the operation of the treadle back of the operation of the treadle back of the treadle as a trigger at the time $S_2$ of FIG. 10. This operation is conducted from the holding (hanging) of the looper thread 7 at the time $S_2$ up to the thread cutting at the time $S_4$ via the driving of the sewing machine for one stitch at the time $S_3$ in the same manner as the control unit 8 shown in FIG. 3.

Thereafter, the control unit 8 issues an operation instruction to the thread pulling back cylinder 90 on the output side together with the needle thread wiping operation at the time $S_5$ of FIG. 10 thereby activating the thread pulling back cylinder 90 to conduct the thread pulling back operation as described hereinbelow. Incidentally, in the timing chart of FIG. 10, the device is constituted in such a manner that the thread pulling back operation is conducted simultaneously with the needle thread wiping operation described above. However, both operations can be conducted separately.

The thread pulling back device 9 which is driven by the thread pulling back cylinder 90 is constituted in such a manner that the device 9 has, as shown in FIGS. 11 and 12, a fixed thread passing portion 91 arranged in the midst of a supply path of a looper thread 7 to the looper 1, with a through holes for the looper thread 7 respectively on two sides of a u-shaped configuration thereof, and a movable thread passing portion 92 having a penetration hole of the looper thread 7, and movably arranged in the direction crossing the looper thread 7 between the two sides of the fixed thread passing portion 91. The movable thread passing portion 92 is attached to an output rod 93 of the thread pulling device 9 to move the movable thread passing portion 92 by the operation of the thread pulling back cylinder 90 thereby pressing the looper thread 7 between the two sides of the fixed thread passing portion 92 to pull back the looper thread 9 from the looper 1.

Such thread pulling back operation is conducted in the state in which the looper thread 7 cut as shown in FIG. 11 is held on the looper thread fluke 3*b* at the tip of the needle threads cutting hook 3 after the sewing machine is forced to be driven for one stitch in the state in which the looper thread 7 is held to cut the needle threads 6*a* and 6*a* and the looper thread 7. So, the pull back force by the operation of the movable thread passing portion 92 is transmitted to the looper thread 7 held on the looper 1 and the looper thread tab 3*b*. As a consequence, as shown in FIG. 11, the looper thread 7 held in the state of dangling from the looper thread tab 3*b* is shortened, so that there is no fear that the external appearance is deteriorated with the accompaniment of a long looper thread 7 at the start portion of the next sewing operation.

Thereafter, when the step-back operation of the treadle is conducted at the time $S_6$ of FIG. 10, the control unit 8 issues an operation instruction to the cloth presser foot cylinder 27 on the output side in accordance with the input of the step-back signal 21*b* thereby operating the cloth presser foot cylinder 27 and raising the pressing washer for pressing the cloth. This enables removal of the sewn cloth from the sewing machine and setting a new sewing cloth.

Figure 13:
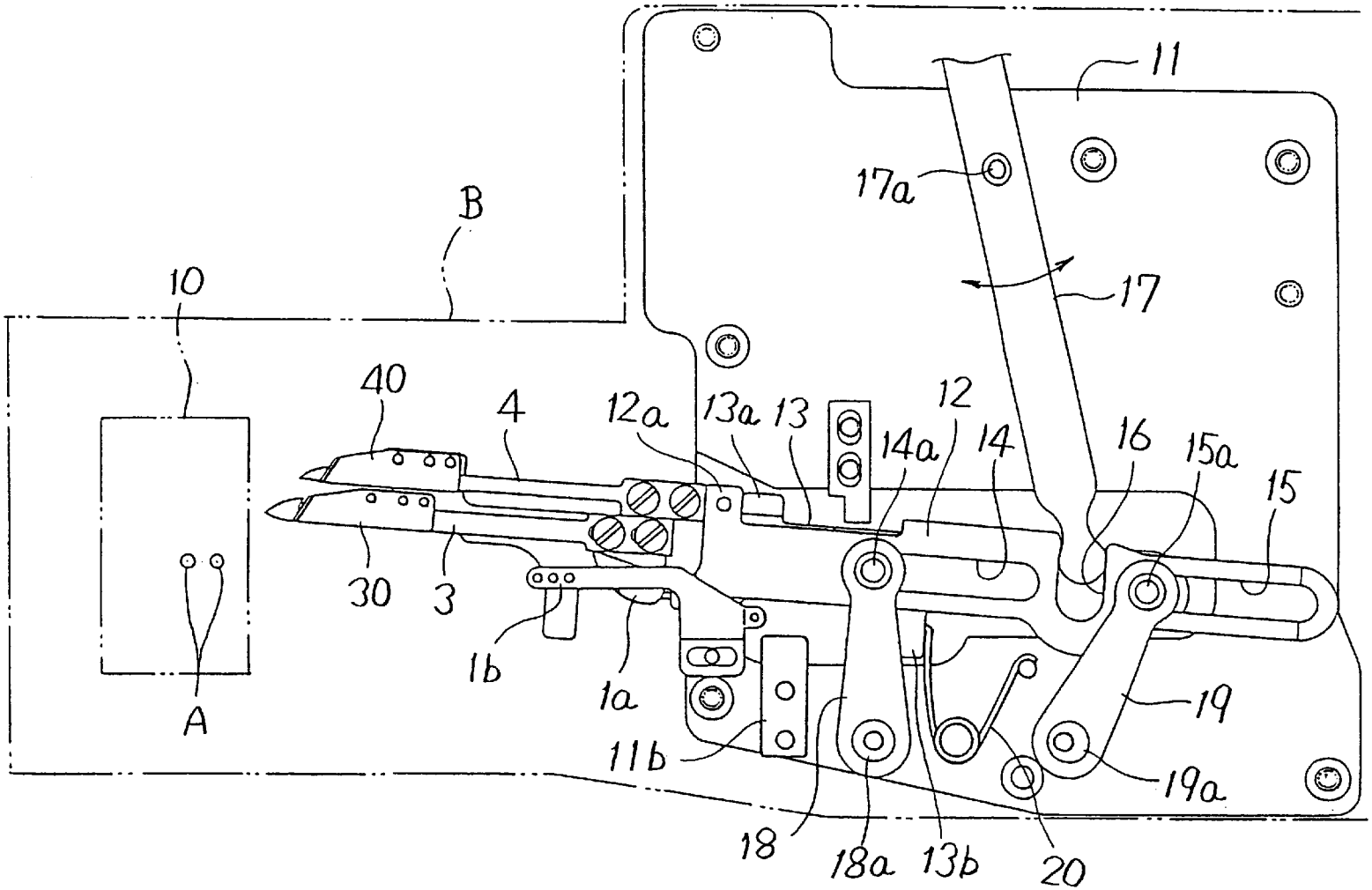
FIG. 13 is a plan view showing another embodiment of means for pulling back the thread.
Figure 14:
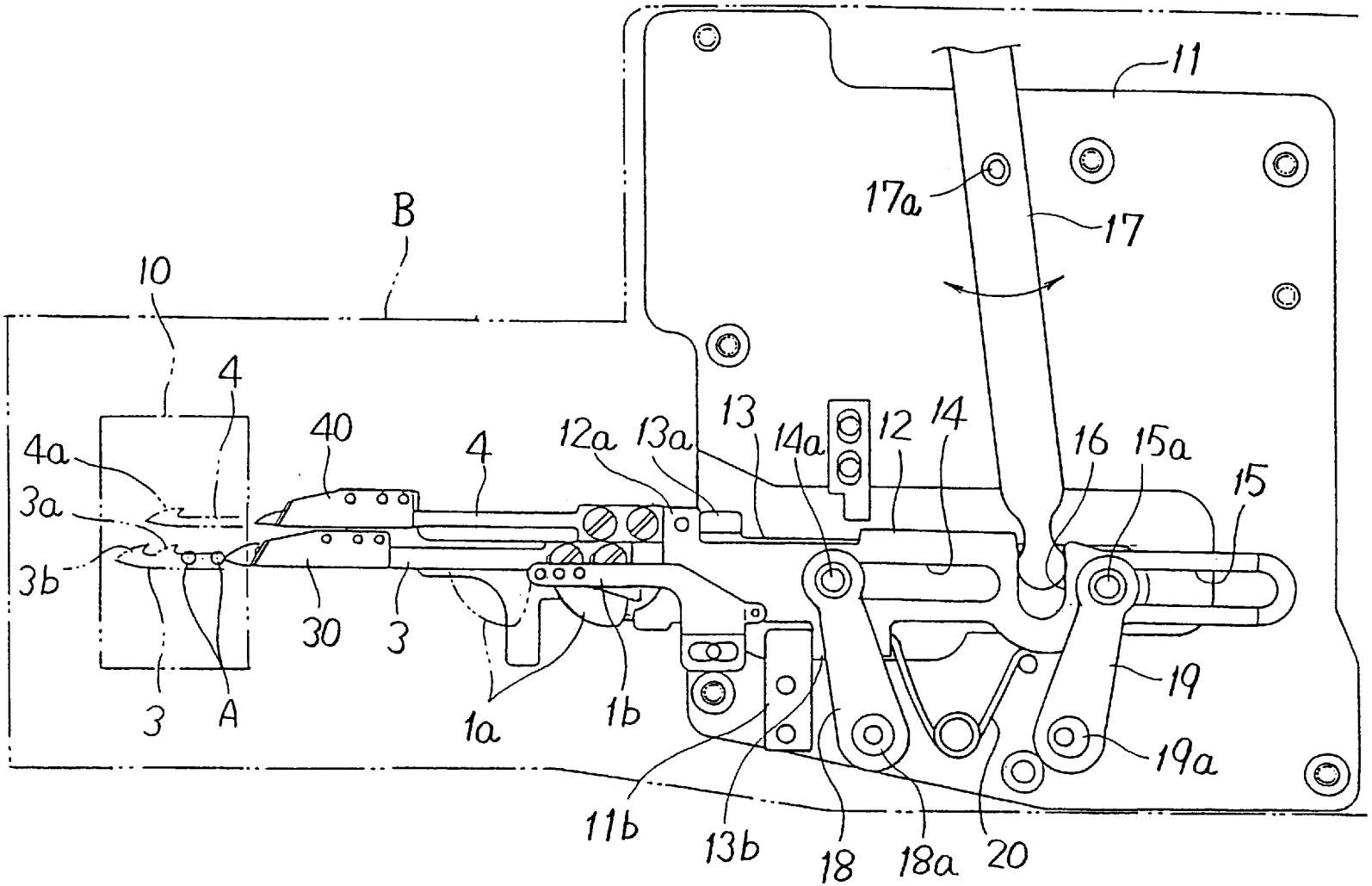
FIG. 14 is a plan view showing further another embodiment of means for pulling back the thread.

The thread pulling back means for pulling back the looper thread 7 can be constituted in an appropriate constitution, and is not restricted to the looper thread pulling back device 9 shown in FIGS. 11 and 12. FIGS. 13 and 14 are plan views showing another embodiment of the thread pulling back means. In FIGS. 13 and 14, the looper thread 7 is pulled back by using the retreat operation of the needle thread cutting hook 3 which occurs for cutting the needle threads 6*a* and 6*a* to pull back the looper thread 7 as described above.

FIGS. 13 and 14 show a structure of an essential portion of the the advance and retreat operation mechanism of the needle thread cutting hook 3 and the looper thread cutting hook 4. In FIGS. 13 and 14, symbol B denotes a sewing bed of the sewing machine. On the upper part on the tip side of the bed B of the sewing machine, a needle plate 10 is laid. Approximately on the central portion of the needle plate 10, needle drop points A and A corresponding to needles 2 and 2 respectively are set. On the side of the base end of the bed B of the sewing machine, a support plate 11 is fixed in parallel with the upper surface thereof. On the upper portion of the support plate 11, a hook base 12 and a knife base 13 formed into a narrow plate-like configuration are arranged in a vertical direction in an overlapped state.

At the tip portion of the hook base 12 extending toward the tip side of the bed B of the sewing machine, the needle thread cutting hook 3 and the looper thread cutting hook 4 are integrally fixed. At the extension end of the knife base 13 extending to the tip side of the bed B thereof, the needle thread knife 30 and the looper thread knife 40 are attached in such a manner that the needle thread knife 30 and the looper thread knife 40 slidably comes into contact with the needle thread cutting hook 3 and the looper thread cutting hook 4 respectively from the upper side as described above.

On the base portion of the hook base 12 which constitutes the attachment base of the needle thread cutting hook 3 and the looper thread cutting hook 4, a pair of guide holes 14 and 15 are arranged in a longitudinal direction thereof, and a U-shaped engaging hole 16 having an opening to the rear side is formed between the pair of the guide holes 14 and 1 5, and one end portion of a thread cutting lever 17 is engaged into the engaging hole 16. The thread cutting lever 17 is pivoted on the pivot pin 17*a* provided on the support plate 11 at the midst thereof to be extended toward the rear side thereof. The extension end of the thread cutting lever 17 is connected to the needle cutting cylinder 31 (see FIGS. 3 and 9), thereby swinging within the surface of the support plate 11 in accordance with the extension and contraction of the needle cutting cylinder 31.

Furthermore, through the guide holes 14 and 15 formed on the hook base 12, respective guide pins 14*a* and 15*a* provided on a scalpel base 13 which constitutes the attachment base of the needle thread knife 30 and the looper thread knife 40 are penetrated. These guide pins 14*a* and 15*a* are connected to one end portion of respective guide arms 18 ana 19, and the other end portion of the guide arms 18 and 19 extending in a forward direction pivoted on a front portion of the support plate 11 with respective pivot pins 18*a* and 19*a*. Furthermore, a spiral spring 20 attached in the front portion of the support plate 11 is forced to be elastically contact the knife base 13 to be energized toward the tip side (the left side of FIG. 13) with a spring force of the helical spring 20 to be integrated in which a stopper piece 13*a* projectingly provided on one part of the rear edge of knife base 13 is pressed against the stopper piece 12*a* projectingly provided on one part of the rear edge of the hook base 12. Furthermore, on one part of the front edge of knife base 13, a stopper piece 13*b* which also serves as a spring seat for the spiral spring 20 is projectingly provided. The movement of the knife base 13 in the left direction is constrained at the position where the stopper piece 13*b* comes into contact with the stopper piece 11*b* attached on the corresponding position of the support plate 11.

FIG. 13 shows a state in which the tip of the needle cutting level 17 is swung to the right direction. At this time, the hook base 12 is pressed against the base end side with the action force to the engaging hole 16 to be positioned as shown in the figure. The guide pins 14*a* and 15*a* are in the state of being pressed against the tip side of each of guide holes 14 and 15. In this state, the guide arm 18 connected to the guide pin 14*a* on the tip side is set in the state approximately parallel to the forward and backward direction while the guide arm 19 connected to the guide pin 15*a* on the base end side is set in the state in which the connection end is inclined to the right side with respect to the forward and backward direction. The hook base 12 and the scalpel base 13 are set in the state in which the base end side thereof is inclined in the forward direction according to a different in length along the forward and backward direction of the guide arms 18 and 19. The needle thread cutting hook 3 and the looper thread cutting hook 4 at the tip of the hook base 12 as well as the needle thread knife 30 and the looper thread knife 40 at the tip of the knife base 13 are set in the wait position at the right back of the needle drop points A and A.

FIG. 14 shows a state in which the needle cutting lever 17 swing in a clockwise direction from the state shown in FIG. 13. The hook base 12 at this time is pressed toward the tip side with the action force to the engaging hole 16 to move to the position shown in the drawings while the knife base 13 is pressed with the spring force of the spiral spring 20 to follow and move. At this time, the guide arms 18 and 19 connected to the guide pins 14*a* and 15*a* swing in an anti-clockwise direction, being pivoted on respective pivot pins 18*a* and 19*a*. As shown in the drawing, the guide arms 18 and 19 are set in the state in which the guide arms 18 and 19 are inclined approximately at the same angle in an opposite direction to each other with respect to the forward and backward direction. As a result, these lengths in forward and backward direction become approximately the same, the movement of the hook base 12 and the knife base 13 is generated along with a swing of the tip portion of the hook base 12 and the knife base 13 in the forward direction, with the result that the needle thread cutting hook 3 and the looper thread cutting hook 4 at the tip of the hook base 12 are located opposite to the right side of the needle drop point A, A together with the needle thread knife 30 and the looper thread knife 40 at the tip of the knife base 13.

Furthermore, at this time, the stopper piece 13*b* projectingly provided at the front edge of the knife base 13*b* comes into contact with the stopper piece 11*b* attached on the support plate 11, so that the knife base 13 is set in the state in which the further movement in the left direction is constrained. The thread cutting lever 17 swings further from this state. With this swing, the hook base 12 which is pressed leftward is moved to the left with the guiding of the guide holes 14 and 15 engaged with the guide pins 14*a* and 15*a*, so that the needle thread cutting hook 3 and the looper thread cutting hook 4 attached at the tip of the hook base 12 are projected from the tip of the needle thread knife 30 and the looper thread scalpel 40 to advance over the needle drop points A and A to provide a state as shown in FIG. 7. Thus, the needle thread knife 30 and the looper thread scalpel 40 retreat with the swing of the thread cutting lever 17 in the opposite direction which is generated thereafter. The needle threads 6*a* and 6*a*, and looper thread 7 caught at this time are cut by the needle thread knife 30 and the looper thread knife 30 as shown in FIG. 8.

The swing of the thread cutting lever 17 in the opposite direction is continued up to the position shown in FIG. 13, so that the needle thread cutting hook 3 and the looper thread cutting hook 4 are moved to the wait position at the right rear side of the needle drop points A and A together with the needle thread knife 30 and the looper thread scalpel 40 to wait until the next operation. At this time, the looper thread 7 held on the looper thread fluke 3*b* at the tip of the needle thread cutting hook 3 is pulled back by utilizing the advance or retreat operation of the needle thread cutting hook 3 by the operation of the thread pulling back means which is constituted as described later, with the result that the looper thread 7 is held in the state of slightly projecting from the held position as shown in FIG. 12.

The thread pulling back means comprises a thread hanging projection (a thread hanging portion) 1*a* located in the vicinity of the attachment position of the needle thread cutting hook 3 to project from the front edge of the hook base 12, a looper thread guide 1*b* attached at the front portion on the left side of the support plate 11 so as to be located at the upper portion of the movement path of the needle thread cutting hook 3, and a looper thread guide 1*c* (see FIG. 15) located under the looper thread path 1*b* to be provided inside of the sewing bed B of the sewing machine.

As shown in FIGS. 13 and 14, the needle thread hanging projection 1*a* is a flat plate projection 1*a* is a flat plate-like projection which continues with a gentle inclination on the left side with respect to the front edge of the hook base 12 and which continues with an abrupt inclination on the right side. When the needle thread cutting hook 3 advances or retreats as described above, the needle thread hanging projection 1*a* moves between the position shown in FIG. 13 and the position shown by two dot chain line in FIG. 14. Furthermore, the looper thread guide 1*b* is a rod-like member on which three thread holes are formed at the tip thereof, and is attached on the front portion on the left side of the support plate 11 in a position adjustable manner so that the needle holes are located on the movement path of the thread hanging projection 1*a*.

Figure 15A:
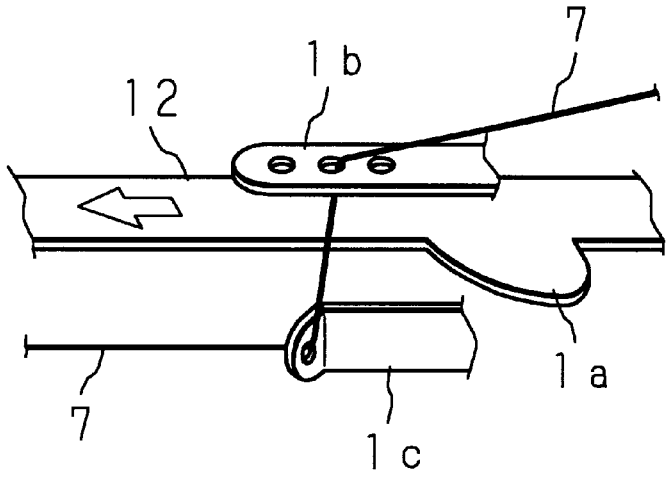
FIGS. 15A through 15C are views for explaining operations of the means for pulling back the thread shown in FIG. 14.

FIG. 15 is a view for explaining an operation of the thread pulling back means shown in FIGS. 13 and 14, the view being shown as a perspective view showing a portion of the vicinity of the thread hanging projection 1*a* and the looper thread guide 1*b* as seen from the front thereof. As described above, the looper thread guide 1*c* is provided under the looper thread guide 1*b*. As shown in FIG. 15A, the looper thread 7 is allowed to pass through the thread hole of the looper thread guide 1*b* on the upper portion to be guided downward across the movement path of the thread hanging projection 1*a*, and is allowed to pass through the thread hole of the looper thread guide 1*c* on the lower portion to be guided in a left direction and to be set in the looper not shown located on the same side with the result that the sewing operation is conducted in this state. At this time, the thread hanging projection 1*a* is located at a position in a right direction far from the looper thread guide 1*b*, and is set in the state without interfering the looper thread 7 between the looper thread guides 1*b* and 1*c*.

Figure 15B:
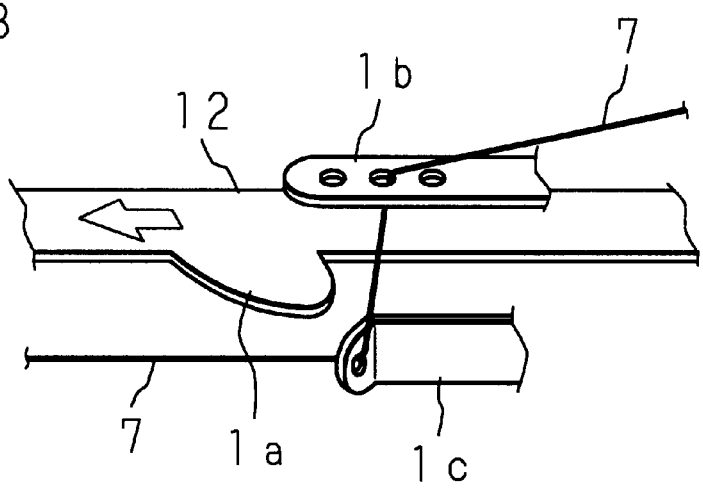
Figure 15C:
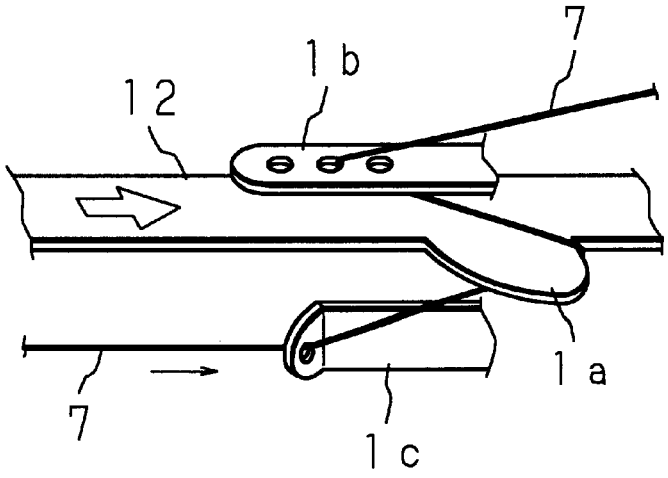

At the time of the completion of such sewing operation, the operation of preventing the raveling of the seam described above is conducted. At this time, the thread cutting hook 3 advances in a left direction as described above to catch the needle threads 6*a* and 6*b*, and the looper thread 7. Subsequently, the needle thread cutting hook 3 retreat toward the right to cut the needle threads 6*a* and 6*b*. At the same time, the needle thread cutting hook holds the looper thread 7. FIG. 15B shows a state in which the needle thread cutting hook 3 has advanced to the left. At this time, the thread hanging projection 1*a* is located left of the looper thread guides 1*b* and 1*c* as shown in FIG. 15B.

In other words, when the operation of preventing the raveling of the seam described above is conducted, the thread hanging projection 1*a* moves from the position shown in FIG. 15A to the position shown in FIG. 15B, along with the movement of the needle cutting hook 3 toward the left. During this time, the thread hanging projection 1*a* passes between the looper thread guides 1*b* and 1*c* to come into contact with the looper thread 7 stretching therebetween. The left edge of the thread hanging projection 1*a* which comes into contact with the looper thread 7 at this time has the gentle inclination as described above, so that the looper thread 7 slides along the inclination with the result that the looper thread 7 goes over the thread hanging projection 1*a* to fall to the right side of the right edge to provide the state shown in FIG. 15B.

Subsequently, the thread hanging projection 1*a* moves from the position shown in FIG. 15B toward the right along with the retreat of the needle thread cutting hook 3 to the right. At this time, the looper thread 7 is caught on the right edge of the thread hanging projection 1*a* having the abrupt inclination, and is pulled toward the right along with the movement of the thread hanging projection 1*a* to provide the state shown in FIG. 15C. At this time, the looper thread 7 is cut on the side supply to the looper by the operation of the looper thread cutting hook 4, which occurs together with the operation of the needle thread cutting hook 3. The pulling back of the looper thread 7 by the thread hanging projection 1*a* occurs on the side which continues to the looper from the looper thread guide 1*c* as shown by an arrow in the drawings.

As a consequence, as shown in FIG. 11, the looper thread 7 held in the state of dangling from the looper thread fluke 3*b* after being cut by the looper thread cutting hook 4 is pulled back with the result that the held length of the looper thread by the looper thread fluke 3*b* is shortened as shown in FIG. 12. Thus, there is no fear that the external appearance is deteriorated with the accompaniment of a long looper thread 7 on the sewing start portion of the next sewing operation.

With the thread pulling back means which is constituted as described above, the cut looper thread 7 is pulled back by utilizing the advance and retreat operation of the needle thread cutting hook 3, so that special thread pulling back means becomes unnecessary. The pulling back quantity of the looper thread 7 can be freely adjusted by changing the selection of the thread hole in the looper thread guide in the upper portion or by changing the attachment position of the looper thread guide 1*b*.

Although, in the above embodiment, the thread cutting projection 1*a* as a thread hanging portion is provided on the front edge of a hook base 12 which serves as an attachment base of the needle thread cutting hook 3, the thread hanging portion may be appropriately provided on the needle thread cutting hook 3 or a part of the hook base 12. Besides, the configuration of the thread hanging portion can be made into an appropriate configuration without being restricted to the configuration shown in the drawings.

As this invention may be embodied in several forms without departing from the spirit of essential characteristics thereof, the present embodiment is therefore illustrative and not restrictive, since the scope of the invention is defined by the appended claims rather than the description preceding them, and all changes that fall within metes and bounds of the claims, or equivalence of such metes and bounds thereof are therefore intended to be embraced by the claims.

What is claimed is:

1. An apparatus for preventing raveling of a seam, which is constructed to be mounted in a sewing machine for sewing a product by allowing a looper which advances from the right side to the left side of a needle drop point to pass through a loop of a needle thread formed at the needle drop point to force the looper thread held by the looper to the twine around the needle thread, said apparatus comprising:

a looper thread hanging hook arranged on the right rear side of the needle drop point to advance or retreat and catch the looper thread in the vicinity of the advance end of the looper at the time of the advance thereof;

a needle thread cutting hook arranged on the right side of the needle drop point to advance or retreat and catch the needle thread being inserted into the loop of the needle thread at the time of the advance thereof;

a needle thread knife slidably contacting the needle thread cutting hook at the time of the retreat of the hook, the knife cutting the needle thread which is caught at the time of the advance of the needle thread cutting hook;

a looper thread cutting hook arranged on the right side of the needle drop point to advance or retreat and catch the looper thread caught by the looper thread hanging hook at the time of the advance thereof;

a looper thread knife slidably contacting the looper thread cutting hook at the time of the retreat thereof, the knife cutting the looper thread caught at the time of the advance of the loop thread cutting hook; and means for controlling an operation of preventing the raveling of the seam, the means causing the sewing machine to temporarily suspend the sewing operation before the end of the sewing in the state in which the looper advances followed by forcing the looper thread hanging hook to advance to catch the looper thread and then forcing the hook to retreat, then forcing the sewing machine to conduct the sewing operation for one stitch in this state, which is then followed by forcing the needle thread cutting hook and the looper thread cutting hook to advance and retreat thereby cutting the needle thread and the looper thread with the needle thread knife and the looper thread knife respectively.

2. The apparatus for preventing the raveling of the seam according to claim 1, further comprising a looper thread holding hook continuously provided at the tip portion of the needle thread cutting hook for catching the looper thread in the vicinity of the advance end of the looper at the time of the advance of the needle thread cutting hook, pulling out the caught looper thread from the final loop of the needle thread at the time of the retreat of the needle thread cutting hook after the advance, to hold the looper thread in front of the needle thread knife.

3. The apparatus for preventing the raveling of the seam according to claim 2, further comprising thread pulling back means for pulling back the looper thread before the supply to the looper in order to shorten the hanging length of the looper thread caught by the looper thread holding hook.

4. The apparatus for preventing the raveling of the seam according to claim 3, wherein said thread pulling back means comprises:

a looper thread guide for holding the looper thread before the supply to the looper so as to cross the advance and retreat path of the needle thread cutting hook; and a thread hooking portion provided on the needle cutting hook or on a part of an attachment base thereof to hook the looper thread held along the looper thread guide at the time of the retreat of the needle thread cutting hook.

5. A sewing machine provided with the apparatus for preventing raveling of a seam of claim 1.

6. An apparatus for preventing raveling of a seam, which is constructed to be mounted in a sewing machine for sewing a product by allowing a looper which advances from the right side to the left side of a needle drop point to pass through a loop of a needle thread formed at the needle drop point to force the looper thread held by the looper to twine around the needle thread, said apparatus comprising:

a looper thread hanging hook arranged on the right rear side of the needle drop point to advance or retreat and catch the looper thread in the vicinity of the advance end of the looper at the time of the advance thereof;

a needle thread cutting hook arranged on the right side of the needle drop point to the advance or retreat and catches the needle thread being inserted into the loop of the needle thread at the time of the advance thereof;

a needle thread knife slidably contacting the needle thread cutting hook at the time of the retreat of the hook, the knife cutting the needle thread which is caught at the time of the advance of the needle thread cutting hook;

a looper thread cutting hook arranged on the right side of the needle drop point to advance or retreat and catch the looper thread caught by the looper thread hanging hook at the time of the advance thereof;

a looper thread knife slidably contacting the looper thread cutting hook at the time of the retreat of the hook, the knife cutting the looper thread caught at the time of the advance of the loop thread cutting hook; and a control unit for controlling an operation of preventing the raveling of the seam, and capable of performing the following operations;

(i) causing the sewing machine to temporarily suspend the sewing operation before the end of the sewing in the state in which the looper advances;

(ii) forcing the looper thread hanging hook to advance to catch the looper thread;

(iii) forcing the looper thread hanging hook to retreat;

(iv) forcing the sewing machine to conduct the sewing operation for one stitch in this state; and (v) forcing the needle thread cutting hook and the looper thread cutting hook to advance and retreat thereby cutting the needle thread and the looper thread with the needle thread knife and the looper thread knife respectively.

7. The apparatus for preventing the raveling of the seam according to claim 6, further comprising a looper thread holding hook continuously provided at the tip portion of the needle thread cutting hook for catching the looper thread in the vicinity of the advance end of the looper at the time of the advance of the needle thread cutting hook, pulling out the caught looper thread from the final loop of the needle thread at the time of the retreat of the needle thread cutting hook after the advance, to hold the looper thread in front of the needle thread knife.

8. The apparatus for preventing the raveling of the seam according to claim 7, further comprising thread pulling back means for pulling back the looper thread before the supply to the looper in order to shorten the hanging length of the looper thread caught by the looper thread holding hook.

9. The apparatus for preventing the raveling of the seam according to claim 8, wherein said thread pulling back means comprises:

a looper thread guide for holding the looper thread before the supply to the looper so as to cross the advance and retreat path of the needle thread cutting hook; and a thread hooking portion provided on the needle cutting hook or on a part of an attachment base thereof to hook the looper thread held along the looper thread guide at the time of the retreat of the needle thread cutting hook.

10. A sewing machine provided with the apparatus for preventing raveling of a seam of claim 6.

* * * * *